United States Patent [19]

Munro

[11] 4,371,203

[45] Feb. 1, 1983

[54] UNIVERSAL BEAM CLAMP

[76] Inventor: Donald C. Munro, P.O. Box 389, Grand Blanc, Mich. 48439

[21] Appl. No.: 282,851

[22] Filed: Jul. 13, 1981

[51] Int. Cl.[3] ..... B66C 1/64

[52] U.S. Cl. ..... 294/86 R; 294/85; 294/103 R

[58] Field of Search ..... 294/67 BB, 85, 86 R, 294/103 R, 106, 116; 24/248 SA, 263 R, 263 A; 104/258; 248/226.1, 228, 316 A; 269/189, 218, 240, 242, 244

[56] References Cited

U.S. PATENT DOCUMENTS

| | | | |
|---|---|---|---|
| 308,356 | 11/1884 | Goodrich | 269/218 |
| 1,125,009 | 1/1915 | Curtis | 294/85 |
| 2,421,257 | 5/1947 | Genter | 24/263 A X |
| 2,877,974 | 3/1959 | Estes | 294/85 X |
| 2,961,269 | 11/1960 | Renfroe | 294/85 |
| 4,221,419 | 9/1980 | Riley et al. | 294/106 |

FOREIGN PATENT DOCUMENTS

| | | | |
|---|---|---|---|
| 683982 | 9/1979 | U.S.S.R. | 294/86 R |

*Primary Examiner*—Johnny D. Cherry
*Attorney, Agent, or Firm*—Cullen, Sloman, Cantor, Grauer, Scott & Rutherford

[57] ABSTRACT

A universal beam clamp for supportably engaging the top flange of an I-beam comprises a pair of opposed symmetrical clamp elements each including a base having an elongated inwardly opening slot along its inner edge. A support plate is mounted upon the base along its edge, there being aligned elongated first and second slots centrally of the support plate. An adjusting screw with separate right and left hand threads extends through the first slots. A nut is mounted on each of the threads outwardly of the support plate and is engageable therewith. A nut retainer upon the support plate prevents rotation of the nut. Rotation of the screw in one direction simultaneously moves the clamp elements inwardly and rotation of the screw in the opposite direction simultaneously moves the support plates outwardly. A support interconnecting the support plates has a base projected through the seconds slots and an apex adapted for connection to a crane operated lift hook.

9 Claims, 4 Drawing Figures

UNIVERSAL BEAM CLAMP

BACKGROUND OF THE INVENTION

In building constructions with a steel framework made up essentially of upright and horizontally disposed I-beams, various types of crane operated lift hooks that have been employed for lifting and positioning the beam so as to span a pair of upright beams and for supporting the beam until it has been interlocked therewith as by bolts or welding.

The difficulty heretofore has been the lack of an effective mechanism which will clamp the I-beam top flange adjacent its opposite ends and which will provide a support adapted to receive a pair of hooks at the ends of chains or cables extending from a lift crane.

One important problem is the effective anchoring of the respective ends of the beam by a suitable clamping means such that the beam can be lifted and normally supported in a horizontal position until it is properly located and secured into position between a pair of right angularly related beams.

There is always the inherent danger in the use of make shift devices for mounting over the ends of the beam, the possibility that these devices may disengage from the beam end and possibly cause a serious accident.

SUMMARY OF THE INVENTION

An important feature of the present invention is to provide a universal beam clamp wherein a pair of said clamps may be applied to opposite sides of an I-beam retainingly engaging its top flange for effectively gripping the beam ends therebetween and to provide a safe means by which the clamps may be suspended from the hooks depending from a chain or cable upon a suitable crane.

A further feature is to provide a universal beam clamp element having a pair of opposed symmetrical clamp elements which may be positioned over opposite edge portions of the top flange of an I-beam adjacent the ends thereof, and wherein the clamp elements are drawn together to effectively secure upon and to grip therebetween the respective beam ends, providing a universal clamp for lifting and transporting the I-beam to a specific location at a building site.

A further feature incorporates within each of the symmetrical clamp elements, a base having an elongated inwardly opening top flange receiving slot along its inner edge together with an upright support plate secured to the base at said inner edge having a pair of centrally arranged, vertically aligned elongated apertures therethrough. The pair of clamp elements are arranged in opposed relation; and a manually rotatable adjustment screw extends transversely and loosely through the respective opposed support plates and is loosely and adjustably secured thereto. Rotation of the screw in one direction draws the clamp elements together simultaneously and rotation of the screw in the opposite direction retracts the clamp elements simultaneously.

A further feature incorporates upon an adjusting screw having separate right and left hand threads of a pair of nuts which are positioned loosely upon the exterior of the support plates and retained against rotation so as to control simultaneous inward or outward movements of the clamp elements on rotation in one direction or other of the adjusting screw.

A further feature includes the use of a pair of nut retainers affixed to the exterior of the respective support plates adapted for housing the nuts and retaining them against rotation and for maintaining them at all times upon the adjusting screw against accidental disengagement therefrom.

A further feature includes the use of a generally triangularly shaped clamp element support having a horizontal base including a pair of registering free ends which are projected through the upper pair of opposed elongated slots in the support plates and suitably secured together and an apex overlying the support plates is adapted for connection to a crane operated lift hook whereby the clamp elements when properly secured to the top flange of an I-beam adjacent its opposite ends are effective for lifting the beam and for transporting the beam to a point of use.

These and other features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
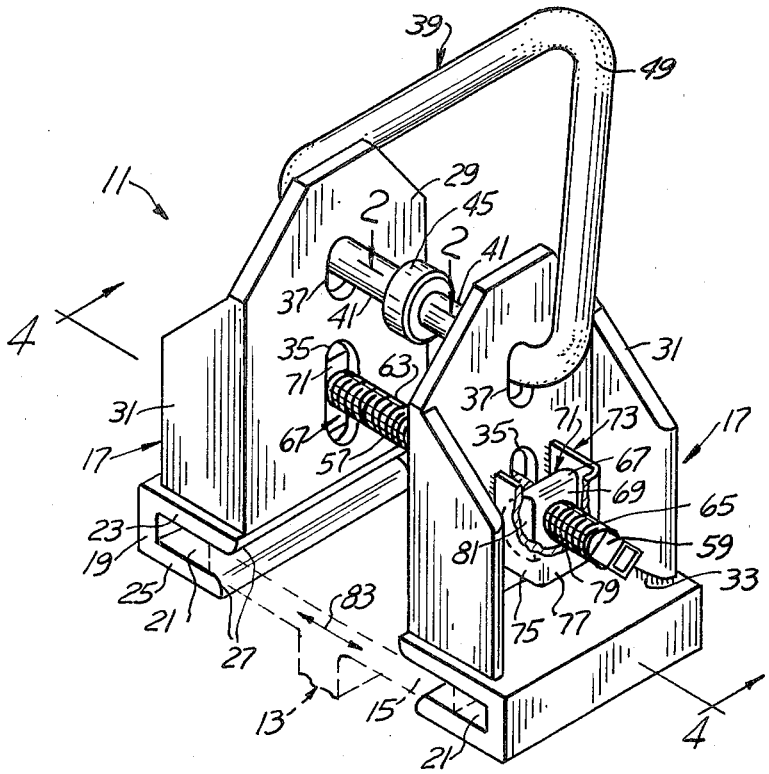
FIG. 1 is a perspective view of the present universal beam clamp with the top flanges of an I-beam fragmentarily shown in dash lines loosely disposed within the separated clamp elements.
Figure 3:
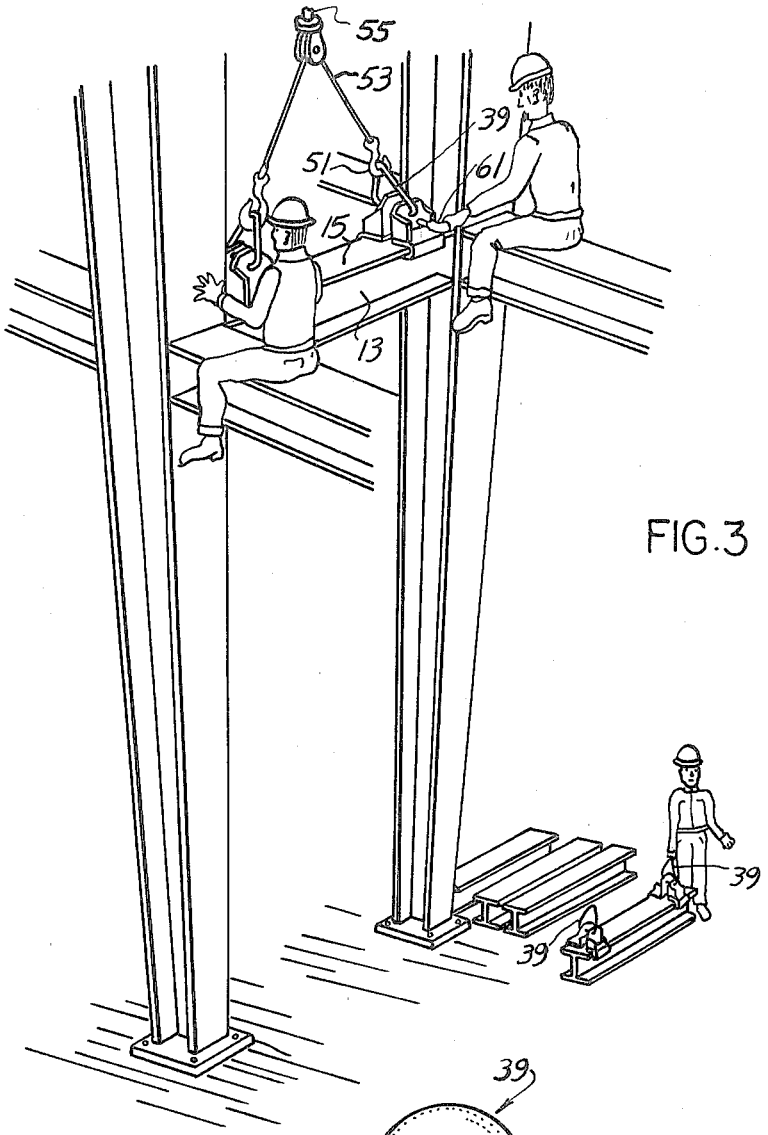
FIG. 3 is a perspective view of a building construction site showing the use of the present universal beam clamp for supporting a horizontally disposed I-beam between a pair of upright beams for securing thereto.
Figure 4:
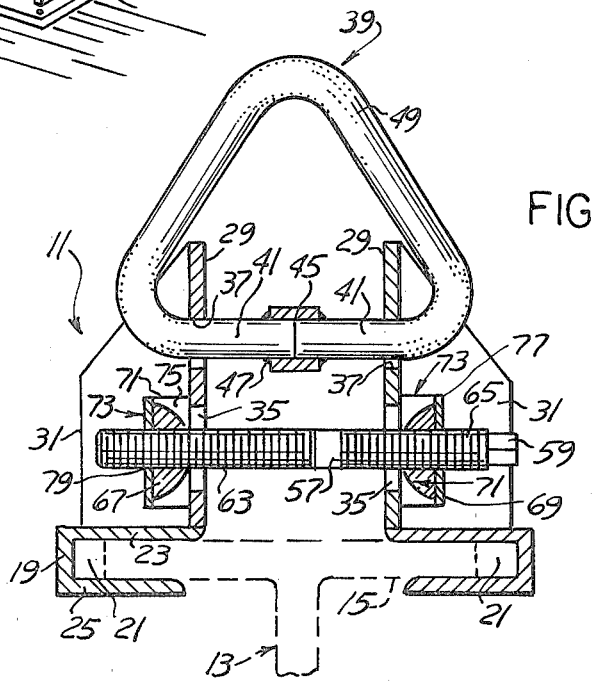
FIG. 4 is a vertical section taken in the direction of arrows 4—4 of FIG. 1.

Referring to the drawings, FIGS. 1 and 3, the present universal beam clamp is generally indicated at 11, adapted to supportably engage opposite sides of the top flange 15 of a conventional I-beam 13. The present universal beam clamp includes a pair of opposed symmetrical clamp elements 17, FIG. 1, with each clamp element including an elongated base 19 of channel form. Each base includes a continuous beam flange engaging inwardly opening elongated slot 21 defined by the parallel spaced top plate 23 and bottom plate 25.

Along the inner edge of the base the inner surfaces of the plates 23 and 25 are curved inwardly at 27 defining a throated opening to facilitate the assembly of the respective clamp elements over the corresponding top flanges 15 of the I-beam 13. Each clamp element includes upon the base 19 at and along its inner edge the upright support plate 29 having the right angularly related reinforcing side flanges 31 secured thereto. The side flanges and the support plate are secured to base 23 by welds 33.

Figure 2:
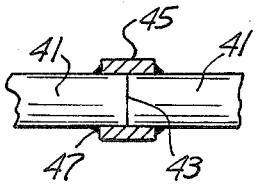
FIG. 2 is a fragmentary section taken in the direction of arrows 2—2 of FIG. 1.

Centrally of the support plate 29 are a pair of vertically aligned elongated slots 35 and 37. Slot 35 is referred to as a screw slot and slot 37 as a hanger slot. Support 39, generally of triangular shape, includes a horizontal base having a pair of inwardly directed registering base ends 41 which project inwardly of the support plates and through the second slots 37 and are in abutment at 43, FIG. 2. Reinforcing joint sleeve 45 overlies the abuting ends of the base elements 41 of the support 39 and is secured thereto by welding at 47.

Support 39 has a central apex 49 which overlies the assembled clamp elements 17 and is adapted to receive a conventional lift hook 51, FIG. 3, secured upon the lower end of a lift chain or cable 53 connected to a crane 55, fragmentarily shown.

An elongated transverse adjusting screw 57 has a square end 59, which could be of hex shape, adapted to receive a suitable wrench such as a socket wrench or a battery operated socket wrench 61 shown in FIG. 3. The adjusting screw includes right hand threads 63 and the separate left hand threads 65, FIG. 1. The adjusting screw extends transversely through the first elongated slots 35 loosely therein. Each of the clamp elements includes the nut 67 upon the outside of the respective support plate threaded onto the adjusting screw and nested within a nut retainer 73 adapted to restrain the respective nuts 67 against rotation.

For this purpose there is provided a nut retainer 73 of U-shape having side walls 75 which engage the outer surface of the support plate and are secured thereto as by welding and include the outer end wall 77. The top and bottom of said retainer is open. End wall 77 of the nut retainer is apertured at 79 to loosely receive the adjusting screw 57. Nut 67 includes a pair of upright side walls 81 which are adapted for cooperative engagement loosely with the interior surfaces of the side walls 75 of said nut retainer. Each nut has an outer upright flat face 69 adapted for cooperative registry with end wall 77 of the nut retainer and an inner arcuate face 71 adapted for cooperative engagement with the adjacent support plate.

OPERATION

The pair of clamp elements are loosely assembled together, FIG. 1, and with the bases 19 separated sufficiently by adjustment of the screw 57 in a counter-clockwise direction. In view of the elongated slots 35 and 37 in the support plates, the respective clamp elements 17 may be tilted outwardly sufficiently so that the respective bases 19 and their inwardly directed slots 21 will cooperatively receive opposite sides of the top flange 15 of the I-beam 13. Once assembled, the clamp elements may assume the spaced apart positions shown in FIG. 1.

On rotation of the screw in a clockwise direction, for example, since the nuts are retained against rotation and the threads are right and left handed, such rotation of the screw will cause the respective nuts to move inwardly towards each other with their corresponding arcuate surfaces 71 operatively engaging exterior surfaces of the support plates 29.

Rotation of the adjusting screw, for example utilizing a battery operated power wrench, such as shown in FIG. 3 at 61, will cause the respective clamp elements 17 to move towards each other as shown by the arrow 83 until there is a snug securing relationship of the clamp elements 17 with respect to the I-beam securing the clamp elements thereto against accidental dislodgment.

At that time utilizing the crane 55, FIG. 3, lift hook 51 and associated chain 53 are lowered to the position shown at the bottom of FIG. 3 until the lift hooks 51 engage the respective supports 39 at the opposite ends of the I-beam. Thereafter, the crane is activated to elevate and translate the beam so that the respective ends of the beam 13 are in cooperative registry between a pair of upright support beams and are so maintained until the I-beam has been effectively secured as by bolts or welding.

Once the I-beam has been secured in position, utilizing the power wrench 61 or other wrench, the adjusting screw is rotated in a counter-clockwise direction causing separation of the clamp elements 17 at the opposite ends of the beam. The nuts 67 move outwardly with respect to the corresponding nut retainers 73 so that their upright flat surfaces 69 engage the end walls 77 of the nut retainers causing the respective clamp elements to retract as shown by arrow 83 sufficiently to disengage the clamp elements from the I-beam.

As shown in FIG. 1, with the use of the power wrench should there be too much rotation of the adjusting screw in a counter-clockwise direction, disassembly of the respective nuts from the screw is prevented because as the screw moves inwardly, the corresponding nut moves outwardly, and the wrench will back off before the screw unthreads itself from the nut.

Having described my invention, reference should now be had to the following claims: I claim:

1. A universal beam clamp for supportably engaging the top flange of an I-beam comprising of a pair of opposed symmetrical clamp elements, each clamp element including an elongated base having an elongated inwardly opening top flange receiving slot along its inner edge;

an upright support plate mounted upon and secured to said base along said edge;

there being aligned upright elongated first and second slots centrally of said support plate;

an adjusting screw extending transversely of said support plates through said first slots, said screw having separate right and left hand threads and a polygonal wrench engaging end;

a pair of nuts mounted on each of said threads outwardly of said support plates;

a nut retainer on said support plate outwardly thereof receiving a nut retaining it against rotation;

rotation of said screw in one direction simultaneously drawing said clamp elements together for gripping the I-beam flange therebetween, rotation of said screw in the opposite direction separating said clamp elements;

and a clamp element support having a base projected through said second slots and an apex overlying said support plates adapted for connection to a crane operated lift hook.

2. In the beam clamp of claim 1, said base being of channel form.

3. In the beam clamp of claim 1, the inner surfaces of the outer opposed edges of said base being transversely curved outwardly providing a throated opening to facilitate positioning of said base over the I-beam flange.

4. In the beam clamp of claim 1, upright right angular side flanges at the ends of said support plate secured thereto and to said base, enclosing said nut and nut retainer.

5. In the beam clamp of claim 1, said first and second slots being oversized in a vertical plane relative to said screw and clamp element base, facilitating outward tipping of said support plates for initial positioning thereof over the I-beam flange along its opposite edges.

6. In the beam clamp of claim 1, each nut having an upright nut retainer engaging surface and an arcuate support plate engaging surface, to accommodate said support plates when tilted outwardly to engage said I-beam.

7. In the beam clamp of claim 1, on said rotation of said screw in the opposite direction, the nuts moving outwardly operatively engaging said nut retainers.

8. In the beam clamp of claim 1, said nut retainer being U-shaped and facing said support plate, having upright side walls and an outer end wall, its top and bottom being open;

said nut having opposed side faces cooperable with said nut retainer side plates and with its opposite ends alternately engaging said support plate and retainer end wall depending upon direction of rotation of said screw.

9. In the beam clamp of claim 1, said clamp element support being triangular in form, with its base having a pair of registering free ends projected through and inwardly of said second slots;

and a reinforcing sleeve overlying said free ends and secured thereto.

* * * * *